US006886981B2

(12) United States Patent
Taniguchi et al.

(10) Patent No.: US 6,886,981 B2
(45) Date of Patent: May 3, 2005

(54) GRAIN BAG

(75) Inventors: Mitsunori Taniguchi, Toyonaka (JP); Keizo Wajima, Matsubara (JP)

(73) Assignee: Tanaka Sangyo Co., Ltd. (JP)

( * ) Notice: Subject to any disclaimer, the term of this patent is extended or adjusted under 35 U.S.C. 154(b) by 118 days.

(21) Appl. No.: 10/292,021

(22) Filed: Nov. 12, 2002

(65) Prior Publication Data

US 2003/0104149 A1 Jun. 5, 2003

(30) Foreign Application Priority Data

Nov. 12, 2001 (JP) ..... 2001-346018
Oct. 21, 2002 (JP) ..... 2002-305615

(51) Int. Cl.[7] ..... B65D 33/16

(52) U.S. Cl. ..... 383/67; 383/6; 383/16; 383/22; 383/41; 24/30.5 R; 24/30.5 L

(58) Field of Search ..... 383/67, 16, 6, 383/22, 24, 41, 86; 274/155, 137, 149, 150, 152, 154; 24/30.5 R, 30.5 L, 615, 307, DIG. 52

(56) References Cited

U.S. PATENT DOCUMENTS 3,827,471 A * 8/1974 Gregory et al. ..... 222/181.3
3,949,901 A * 4/1976 Tokita ..... 222/94
4,299,605 A * 11/1981 Aiyama et al. ..... 55/370
5,894,780 A * 4/1999 Taniguchi ..... 71/9

* cited by examiner

*Primary Examiner*—Robin A. Hylton
(74) *Attorney, Agent, or Firm*—Thompson Hine LLP

(57) ABSTRACT

A grain bag is comprised of a cylindrical barrel having a lid openable and closable upwardly and a bottom part having an outlet tube at a center of a undersurface thereof, and developed with a flap attached in the vicinity of the outlet tube for shielding the outlet tube, a latch attached to a border of the flap through a contact string, and a latch retainer attached to a side of the barrel for catching the latch enabling engagement and disengagement of the latch and the latch retainer at the side of the barrel. The number of latches and latch retainers varies from one to plural numbers according to a size of a bag. Apart from a latch with a contact string and a latch retainer, looped strings are provided and coupled together by a hook.

2 Claims, 5 Drawing Sheets

GRAIN BAG

FIELD OF THE INVENTION

This invention relates to improvement of a grain bag which increases operational safety by realizing easy open and close of an outlet provided on a bottom of a bag.

DESCRIPTION OF PRIOR ARTS

Conventionally, various types of grain bags have been used and a typical structure of those is, for example, composed of a cylindrical barrel having a lid openable and closable upwardly, a bottom part having smaller diameter of cylindrical outlet tube at a center thereof, and a chrysanthemum shaped bottom support item for blockage of the bottom part.

When a conventional grain bag is used, a nozzle of an outlet tube at a bottom part is tied up with a string and then folded down. A chrysanthemum shaped bottom support item is further tightened to develop a bottom part. Then the bag is slung up with a suspensory string or the like attached to a barrel, and thereby grains can be thrown in through a top. This manner has required much time from forming a bottom to putting grains in.

Also, in the case that grains are to be released from this bag, the bag is slung around a relatively high place to unlace a tightened string of the chrysanthemum shaped bottom support item from beneath the bag and further unlace a string of an outlet tube for releasing grains from the outlet tube at a burst.

A weight of a filled bag, however, amounts to over one ton in some cases, and therefore working beneath a bag for opening a bottom of the bag has been dangerous in the light of possibility of the bag's precipitation.

A purpose of the present invention is to provide a grain bag which enhances operational safety by facilitating opening and closing of a release flap at a bottom.

SUMMARY OF THE INVENTION

To solve the aforesaid conventional problem, the present invention adopts a grain bag comprising of a cylindrical barrel having a lid openable and closable upwardly and a bottom part having an outlet tube at a center of a undersurface thereof, and developed with a flap attached in the vicinity of the outlet tube for shielding the outlet tube, a latch attached to a border of the flap through a contact string, and a latch retainer attached to a side of the barrel for catching the latch enabling engagement and disengagement of the latch and the latch retainer at the side of the barrel.

In the grain bag with the above structure, blocking a bottom is effortless since a folded outlet tube is shielded with a flap and a latch is caught at a side of a barrel. Even if grains are thrown in, as the folded outlet tube is to be squashed by it's own weight and blocks a passage of grain completely, non-leakage is ensured. In addition, working beneath a bag is no longer required as disengagement can be carried out at a side of a barrel of a grain bag.

The number of latches and latch retainers varies from one to plural numbers in accordance with a size of a bag to ensure that a flap can block a bottom part of a bag firmly.

Further, apart from a latch with a contact string and a latch retainer, a manner in which looped strings attached to a latch with a contact string and a latch retainer are coupled together by a hook, is adopted.

Coupling looped strings prevents stored objects from leading even if a latch is disengaged inadvertently, for the coupled looped strings hold a flap complementarity and does not allow the flap to open.

DETAILED DESCRIPTION OF THE PREFERRED EMBODIMENT

Hereafter, preferred embodiments are discussed referring to the attached drawings.

Figure 1:
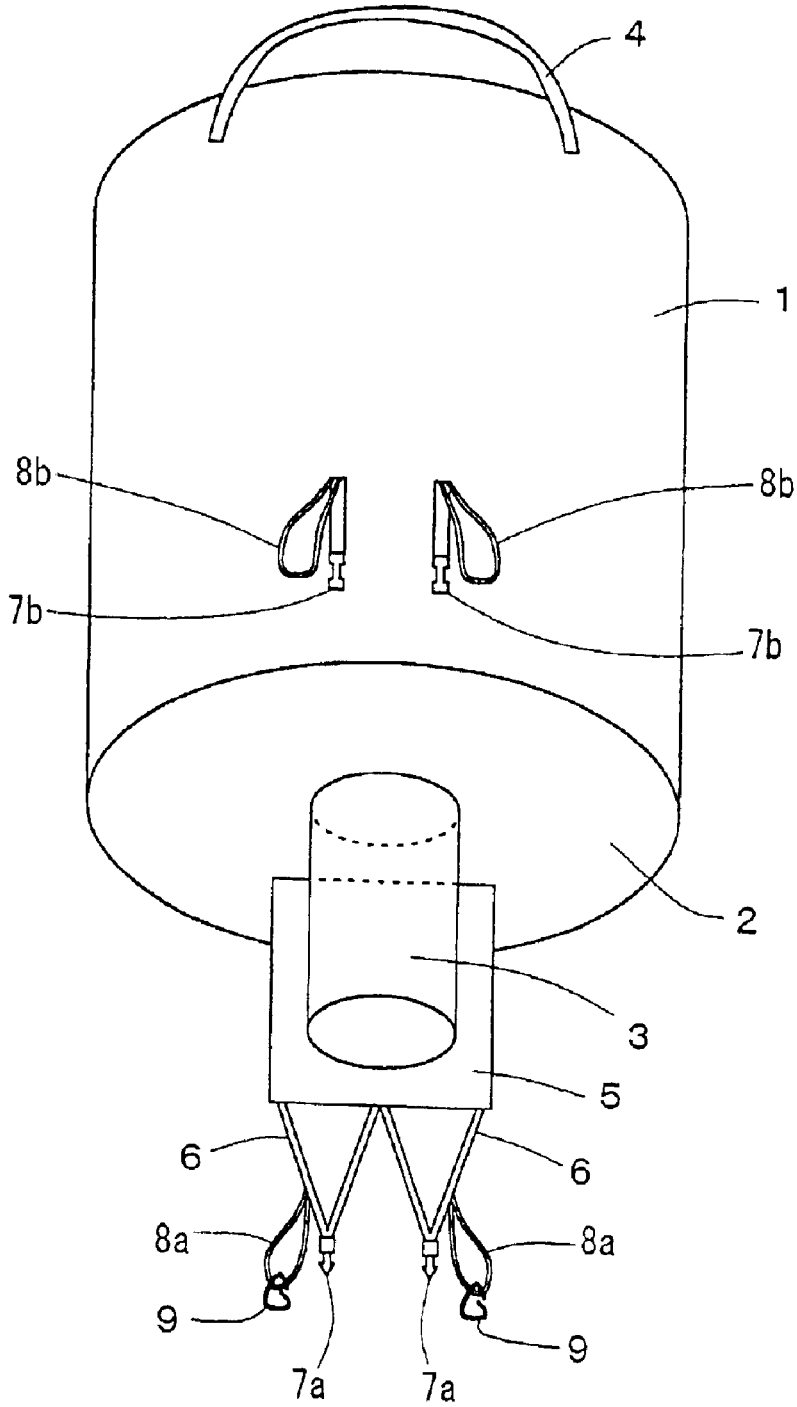
FIG. 1 is a developed perspective view of a grain bag in the present invention.
Figure 1A:
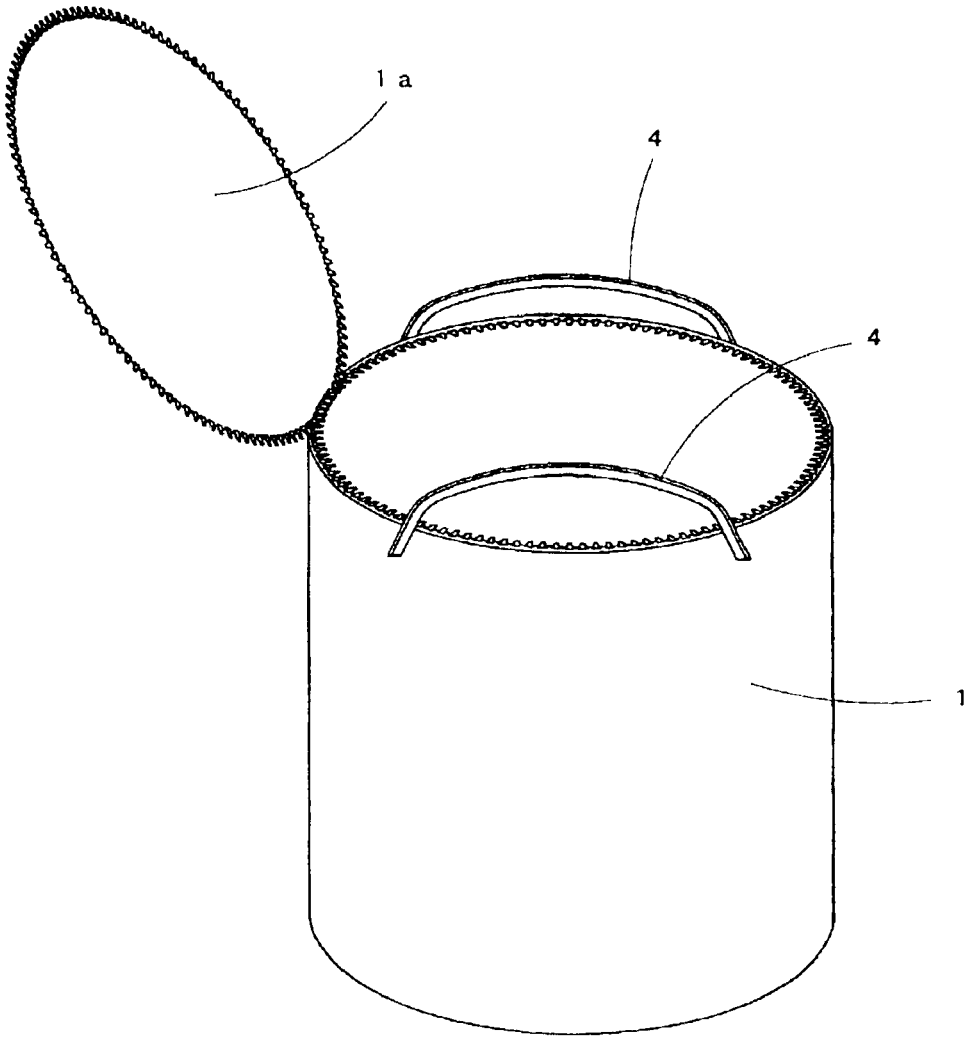
FIG. 1*a* is a perspective view of a common grain bag showing a lid.

In the FIG. 1, 1 is a cylindrical barrel having a lid (shown in FIG. 1*a* as a common structure of a lid 1*a*) openable and closable upwardly with a fastener, 2 is a bottom part on a undersurface of the barrel in which an outlet tube 3 is provided at a center for releasing stored objects such as grains, and 4 is a suspensory string, whereby this bag is slung with a crane or the like. The above structure is similar to that of this kind of conventional grain bag.

5 is a rectangular shape of flap, one side of which is sewed in the vicinity of the outlet tube 3. This flap has a size sufficient to shield the outlet tube 3 being folded and a latch 7*a* is attached to a border of the flap through a contact string 6. This latch 7*a* is caught by a latch retainer 7*b* which is provided at the barrel 1 and will be explained later. Further, another looped string 8*a* is attached to the contact string 6 and 9 is a hook retained at the looped string 8*a*.

In the barrel 1, the latch retainer 7*b* is attached at a position in order to correspond to that of the latch 7*a* for coupling together and is to be coupled at a side of the barrel. A one-touch type is preferable for the latch 7*a* and the latch retainer 7*b* to couple and decouple each other and all kinds of well-known items for latches and latch retainers can be usable. Moreover, a looped string 8*b* is attached along the latch retainer 7*b*. Since the latch 7*a* and the latch retainer 7*b* function in pairs as one latch item, it will be also suitable to attach the latch retainer 7*b* and the latch 7*a* to the flap 5 and the barrel 1 respectively.

The looped strings 8*a* and 8*b* and the hook 9 are reservedly or complimentarily provided in considering a case that the latch 7*a* and the latch retainer 7*b* are decoupled for some reasons. Also, the number of a pair of latch item is two in this Fig. but should not be limited to this number. That is, the number will be freely varied from one to plural numbers in accordance with a size of a bag.

Figure 3:
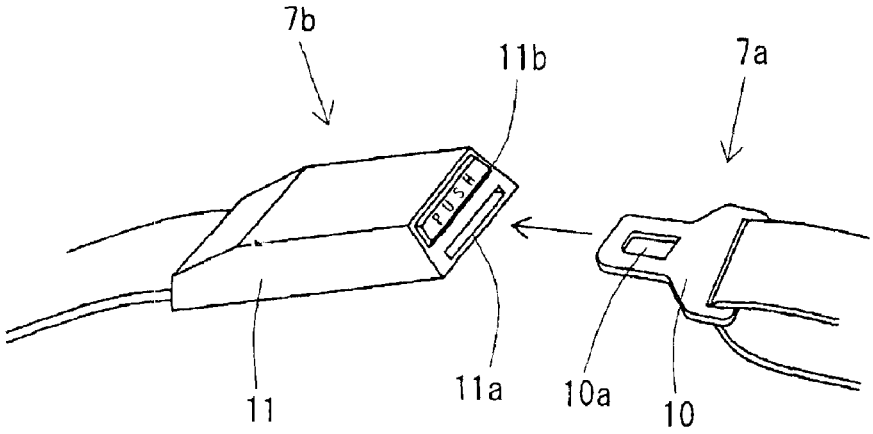
FIG. 3 is a perspective view showing a first example of a latch and a latch retainer.

Concrete examples of a pair of latch composed of the latch 7*a* and the latch retainer 7*b* are shown in FIG. 3 through FIG. 6. FIG. 3 is a type of latch widely applied to seat belts of automobiles. The latch 7*a* has a catching hold 10*a* at a tip of a tapered metal plate 10 while the latch retainer 7*b* has a buckled shape with a fit hole 11*a* at a tip of a box body 11 to which the metal plate can be inserted, and a release button 11*b* in the vicinity of the fit hole 11. This pair of latch can be surly coupled by simply inserting the metal plate 10 into the fit hole 11*a* and also decoupled by pushing the release button 11*b*.

Figure 4:
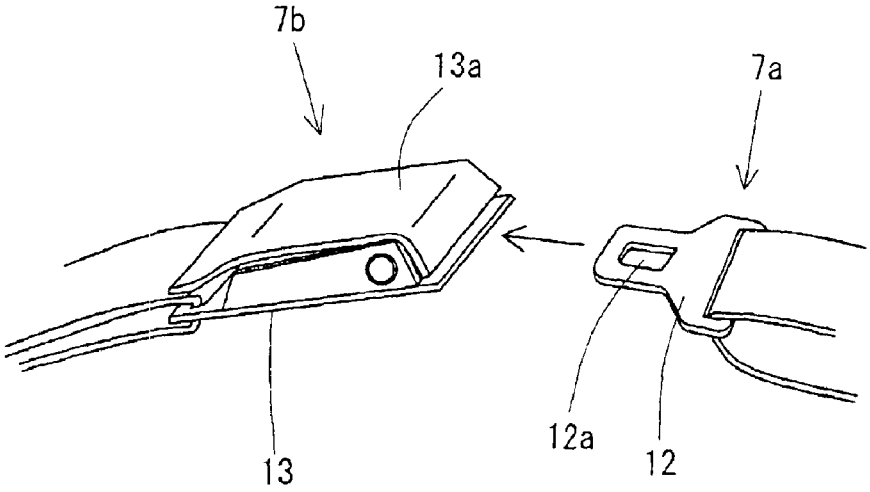
FIG. 4 is a perspective view showing a second example of a latch and a latch retainer.

FIG. 4 is a type of latch applied to seat belts of aircrafts and so forth. The latch 7*a* is a metal plate 12 having a catch hole 12*a* at a tip thereof and the latch retainer 7*b* is a buckle with a structure that a base body 13 has a rotatable retainer plate 13*a* thereto. This pair of latch is to be coupled by inserting the metal plate 12 into a slot between the base body 13 and the retainer plate 13*a* and be decoupled by lifting an end of the retainer plate 13*a*.

Figure 5:
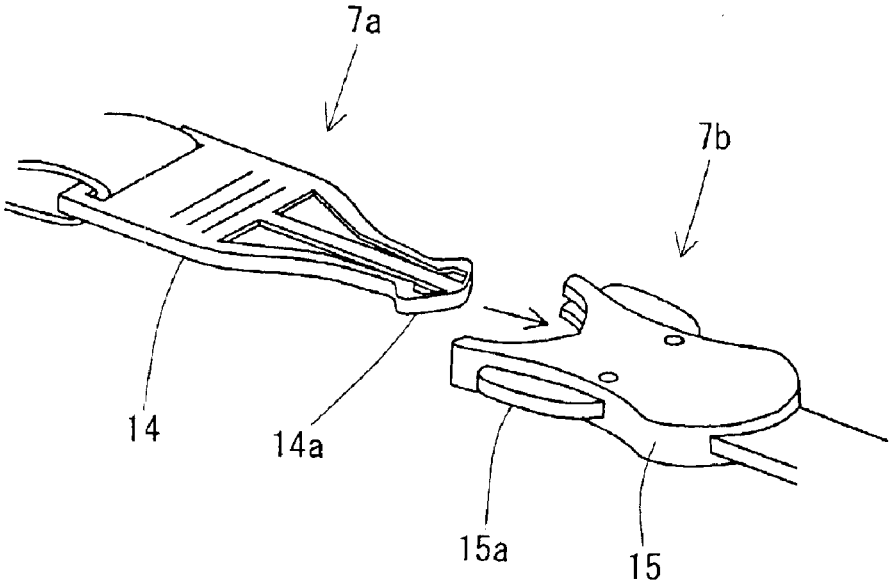
FIG. 5 is a perspective view showing a third example of a latch and a latch retainer.

FIG. 5 is an example of a synthetic resin buckle applied to belts of bags and waist porches and so forth. The latch 7*a* is composed of an arrowhead plate 14 having an engaging part 14*a* at a tip thereof. The latch retainer 7*b* is composed of a base body 15 and release buttons 15*a* protruding from both sides of the base body 15. This pair of latch can be engaged with the engaging part 14*a* by inserting the plate 14 into the base body 15 and also disengaged by pushing the release buttons 15*a* from both sides.

Figure 6:
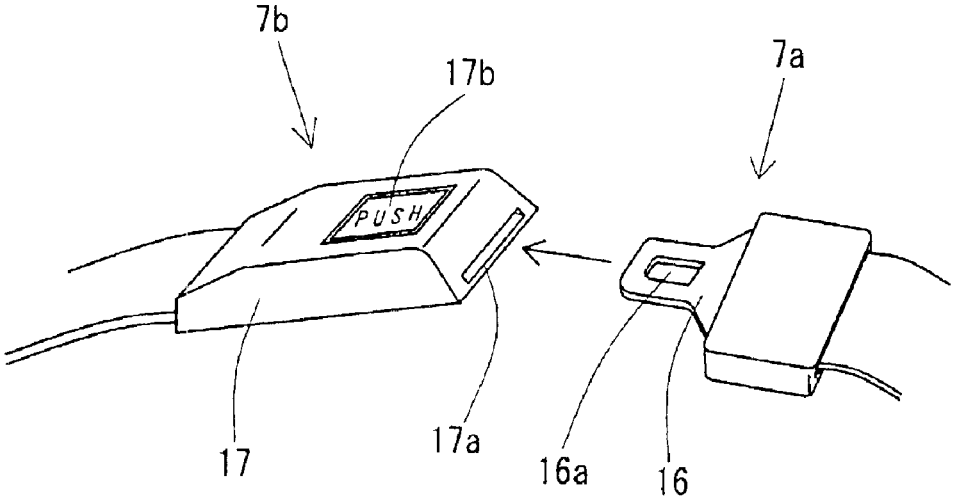
FIG. 6 is a perspective view showing a fourth example of a latch and a latch retainer.

FIG. 6 is a type of latch applied to baby cars, child seats and so forth. The latch 7*a* is a metal plate 16 having a catch hole 16*a* at a tip thereof while the latch retainer 7*b* is composed of a base body 17 with a fit hole 17*a* at a front of the base body 17 and a release button 17*b* on a top of the base body 17. This pair of latch can be coupled by inserting the metal plate 16 into the catch hole 17*a* and also decoupled by simply pushing the release button 17*b*.

The aforesaid pairs of latches are only illustrations, and therefore a type of latch should not be limited to the aforesaid and will include any well-known structures. That is, any pair of latch, a latch and a latch retainer of which can couple together easily and shield firmly the bottom 2 of a bag with the flap 5 will be applicable. In the case that a bag is filled with grains and a pair of latch is tense with high loads, the latch may sufficiently bear the loads. Further, when grains are released, a pair of latch which can be decoupled with one touch is preferred.

Figure 2:
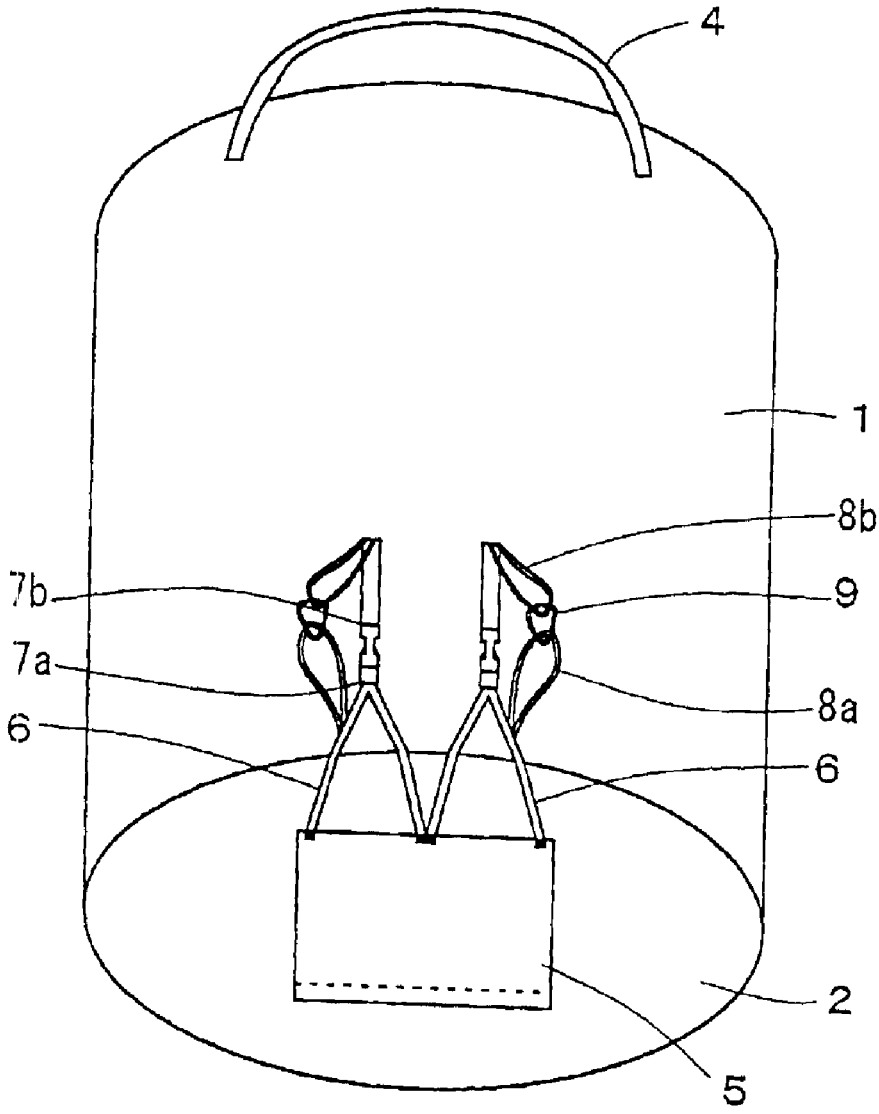
FIG. 2 is a perspective view showing a condition in use in which a bottom part is blocked.

Hereafter, usage of this bag is discussed. As shown in the FIG. 2, the outlet tube 3 after suitable folded up is shielded by the flap 5 and then the latch 7*a* and the latch retainer 7*b* are coupled together through the contact string 6 prior to use. The looped strings 8*a* and 8*b* are coupled each other with the hook 9. As each pair of latch items is attached in an engaged condition to a position to stretch the flap 5, a structure of the bottom part becomes firm and does not allow grains to penetrate in the outlet tube 3 and leak from the bottom part even if grains are thrown in and loads are applied to the bottom part under this condition. In other words, the folded outlet tube 3 is squashed under the loads of thrown grains and prevents leakage of the grains surely. Also, even if the latch item is decoupled inadvertently, the flap 5 will not open keeping grains remain inside, for the looped strings 8*a* and 8*b* are coupled through the hook 9.

When stored grains are released, a bag is slung with a crane of the like through the suspensory string 4. A worker does not need to go beneath the bag as required in a conventional bag and can decouple the latch 7*a* and the looped string 8*a* with the latch retainer 7*b* and the looped string 8*b* respectively from a side of the bag to remove the flap 5. Then, the outlet tube 3 which has been folded under loads of grains can develop for releasing grains outside without difficulty.

As described above, a grain bag in the present invention is free from a difficulty of working beneath a bag for opening a bottom part at a point of releasing grains, for an outlet tube is shielded by a flap with a latch item coupled at a side of a barrel, thereby grains can be released by decoupling the latch item from a side of the bag without trouble. Accordingly, operational safety has noticeably increased, and also opening a bottom part has become easy and simple compared to a conventional way.

Moveover, looped strings coupled through a hook along with a latch item secures further safety as they prevent a flap from opening even if the latch item is decoupled inadvertently.

Further, as blockage of a bottom part is completed by shielding a prefolded outlet tube with a flap and by coupling a latch and a latch retainer together, operational efficiency will increase owing to the above concise procedure compared to a conventional bag using a chrysanthemum shaped bottom support item.

What is claimed is:

1. A grain bag comprising:

a cylindrical barrel having a lid that is openable and closeable and having an outlet tube on an undersurface of the cylindrical barrel;

a flap attached to the undersurface of the cylindrical barrel that is movable between an open position to a closed position, the flay shielding the outlet tube when in the closed position;

a latch operably attached to a border of the flap;

a latch retainer attached to a side of the barrel for catching the latch thereby enabling engagement and disengagement of the latch and the latch retainer at the side of the barrel;

a first looped string attached to the side of the cylindrical barrel;

a second looped string operably attached to the flap; and a hook for coupling the first and second looped strings.

2. A grain bag as claimed in claim 1, wherein the first looped string, the second looped string and the hook are sized to hold the flap in the closed position when the first looped string and the second looped string are coupled together by the hook.

* * * * *